United States Patent [19]

Hopkins et al.

[11] Patent Number: 4,480,888

[45] Date of Patent: Nov. 6, 1984

[54] MULTI TERMINAL LOW INSERTION FORCE CONNECTOR

[75] Inventors: John R. Hopkins, Cambridge, Md.; Leon T. Ritchie, Clearwater, Fla.

[73] Assignee: AMP Incorporated, Harrisburg, Pa.

[21] Appl. No.: 391,312

[22] Filed: Jun. 23, 1982

[51] Int. Cl.[3] ..... H01R 13/62

[52] U.S. Cl. ..... 339/74 R; 339/75 MP

[58] Field of Search ..... 339/75 M, 75 MP, 74 R, 339/75 R, 14 R

[56] References Cited

U.S. PATENT DOCUMENTS

| | | | |
|---|---|---|---|
| 1,697,503 | 1/1929 | Hollwitz . | |
| 2,851,669 | 9/1958 | Koch . | |
| 2,926,328 | 2/1960 | Flanagan . | |
| 3,340,439 | 9/1967 | Henschen et al. . | |
| 3,538,486 | 11/1970 | Shlesinger, Jr. | 339/74 R |
| 4,350,402 | 9/1982 | Dowty et al. | 339/74 R |

FOREIGN PATENT DOCUMENTS

| | | | |
|---|---|---|---|
| 1072746 | 1/1960 | Fed. Rep. of Germany | 339/75 R |
| 1386638 | 12/1964 | France | 339/74 R |

*Primary Examiner*—Z. R. Bilinsky

*Attorney, Agent, or Firm*—Russell J. Egan

[57] ABSTRACT

A multiple terminal connector has structure which causes the profile of the multiple terminals contained therein to be altered thereby allowing low force insertion of the terminals into respective conductive holes of a multi-apertured device, such as a ceramic integrated circuit. The terminal connector comprises two pieces of insulative material forming a housing. The first housing portion has a plurality of terminals mounted therein and the second portion of the housing is moveable with respect to the first portion along the axial length of the terminals to modify the profiles thereof to facilitate their insertion into multiple plated holes of an integrated circuit board or the like.

9 Claims, 14 Drawing Figures

14
76
62
34
58
54
48
16
20
10
44
38
22
52
50
60
18
42
74
66
56
40
36
70
46
50
64
12
72
68

MULTI TERMINAL LOW INSERTION FORCE CONNECTOR

The present application relates to a low insertion force multiple terminal connector system, and in particular, one which modifies the actual profiles of multiple terminals allowing their low force insertion into a like number of conductive apertures after which they return to their original profile to make electrical and mechanical contact with the aperture walls.

It is known in the prior art to have multiple arrays of terminals with the terminals fixed in either an open condition in a circuit board or enclosed in a header. The terminals are then used to make contact with a further connector or with a circuit board or the like having a plurality of spaced apart plated apertures for making contact with the appropriate pin terminals. It is even known, for example in U.S. Pat. No. 3,340,439, to have pin type terminals which can be deformed so as to facilitate insertion into an aperture. A somewhat similar concept is employed on socket terminals in U.S. Pat. No. 1,697,503. In this latter patent a cam plate is rotated to be cammed axially of the sockets to cause them to close gripping a pin terminal therein.

The present invention goes beyond the above discussed prior art by providing a multiple terminal connector assembly which deforms the actual cross section of the terminals to allow a low force insertion thereof into corresponding conductive holes or with pin terminals. The connector assembly has a two part housing formed by a frame and an actuator, both made of insulative material. A plurality of terminals are mounted in a circuit board to be acted upon by the frame. The actuator is mounted so as to move the frame in a direction normal to the surface of the circuit board while staying substantially parallel thereto. The frame has a plurality of uniform holes through which the terminals extend. Each terminal has a first end profiled for fixed mounting in a circuit board or the like, an intermediate portion extending through the frame, and a mating end formed by two normally diverging semi-cylindrical contact portions with profiled ends which, when drawn together, form a substantially smooth nose with or without an axial aperture. Movement of the frame axially along the second end of the terminals draws the free contact portions together into a cylindrical shape allowing the insertion into a like array of conductive holes in a device. As an alternative, the contact portions of the pin terminals can be drawn together to grip a pin terminal therebetween.

An embodiment of the present invention will now be described by way of example with reference to the accompanying drawings in which.

Figure 1:
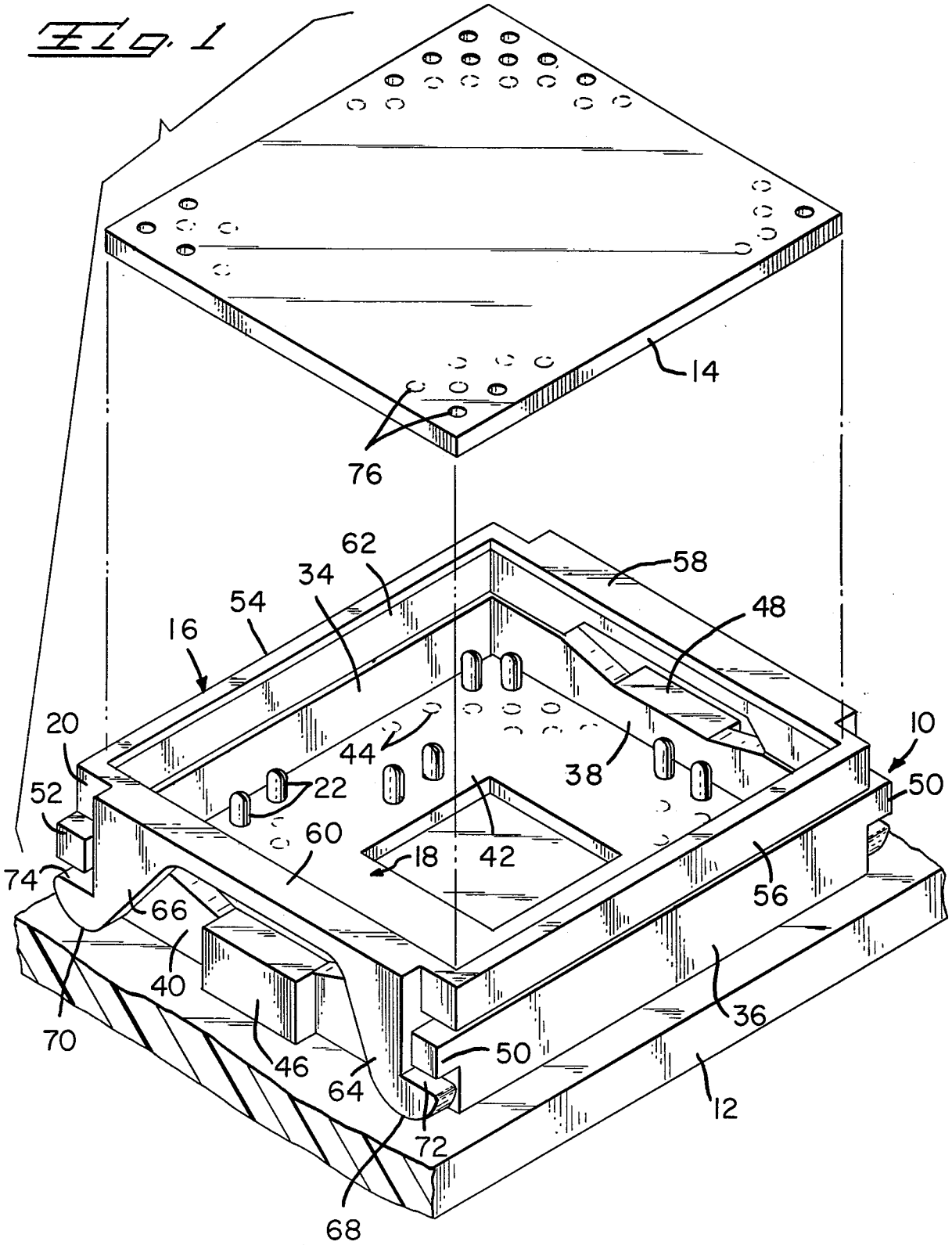
FIG. 1 is a perspective view of the subject invention mounted on a circuit board and with a mating substrate exploded therefrom.

The subject connector assembly 10 is shown mounted on a standard circuit board 12 and is used to electrically and mechanically engage a substrate 14 therewith. The connector assembly 10 is formed by a housing 16 having an inner terminal frame 18 and an outer actuator frame 20 and a plurality of terminals 22.

Figure 2:
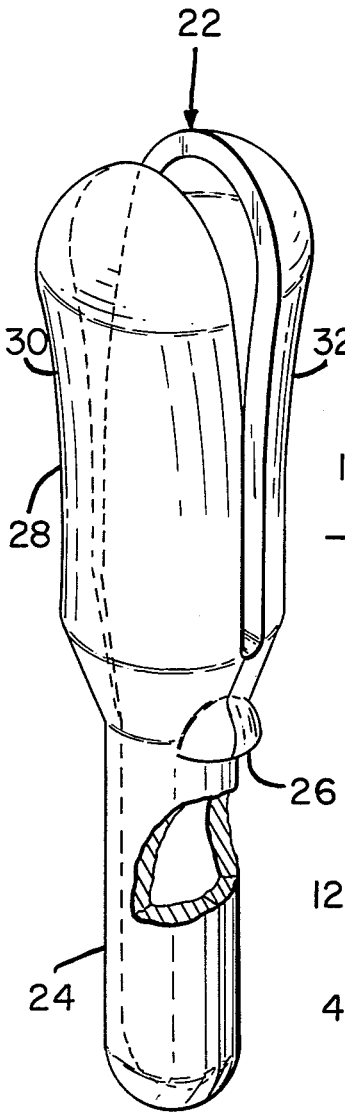
FIG. 2 is a perspective view, partially in section, of a single terminal according to the present invention.
Figure 3A:
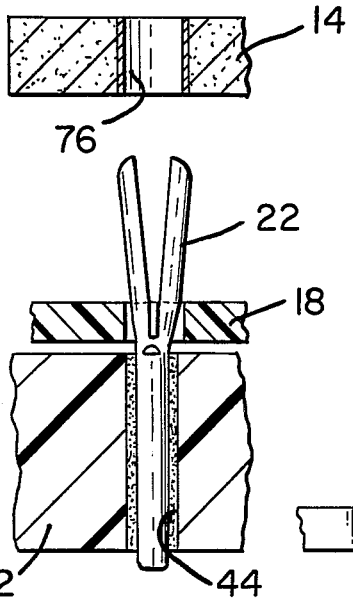
FIG. 3A is a fragmentary section through the invention of FIG. 1

The individual terminals 22 can best be seen in FIG. 2. Each terminal 22 is stamped and formed from conventional conductive material so as to have a lower mounting portion 24, a lug or stop 26 intermediate the ends of the terminal, and a mating end 28 formed by a pair of identical cylindrical arms 30, 32 profiled at their free ends to form a single smooth surface of transition in the engaged position. The arms 30, 32 are normally diverging as shown in FIG. 2 and FIG. 3A.

The housing 16 is formed by the inner terminal frame 18 and outer actuator frame 20, both of which are made of insulative material, such as plastic. The inner terminal frame 18 is a relatively rigid member having integral side walls 34, 36, end walls 38, 40, and a central web 42 with an array of holes 44 spaced thereabout. The opposite end walls 38, 40 of the inner frame 18 are profiled to have a central lugs 46, 48, which normally lie against the circuit board 12, and a pair of actuating lugs 50, 52 projecting from opposite ends of the side walls 34, 36 and spaced from the circuit board 12.

The outer actuator frame 20 is also of an insulating material, such as plastic, but is somewhat more flexible than the inner frame 18. The outer frame 20 is a generally rectangular piece formed by integral side rails 54, 56 and end rails 58, 60 to enclose the web portion 42 of the inner frame 18 and define a central opening 62 which receives the substrate 14 therein. Depending from each end of each end rail 58, 60 are outwardly directed cam lugs 64, 66 each having arcuate cam surfaces 68, 70 which engage the circuit board 12 and oppositely directed shoulders 72, 74 which engage the lugs 50, 52, respectively.

The substrate 14 is of any well known configuration and has a plurality of apertures 76 in a spaced array therein. Each of the apertures 76 is preferably plated or otherwise made conductive and is used to interconnect circuitry (not shown) of the substrate 14 in a well known manner.

Figure 3B:
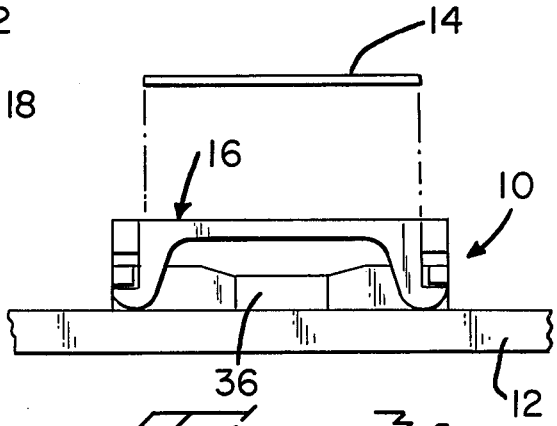
FIG. 3B is a schematic side elevation of the invention as shown in FIG. 3A.
Figure 4A:
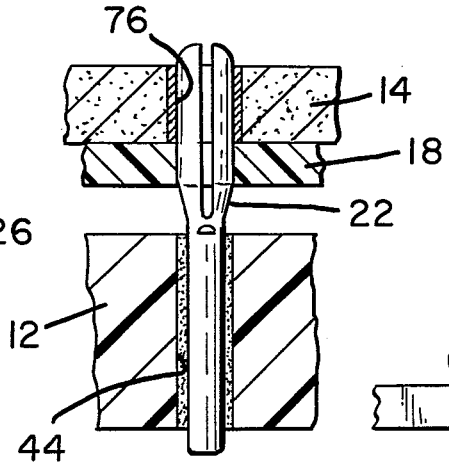
FIG. 4A is a fragmentary section showing the invention in an insertion condition and FIG. 4B is a schematic side elevation of the invention as it would be positioned for FIG. 4A.
Figure 4B:
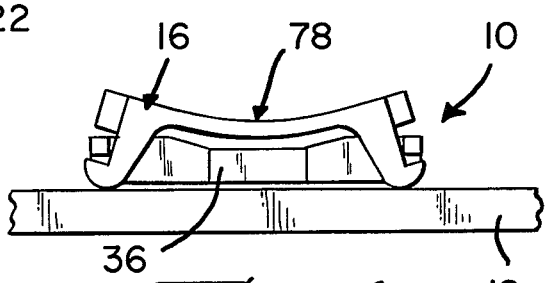
Figure 5A:
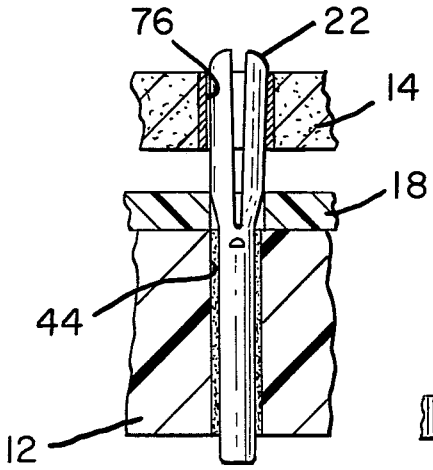
FIG. 5A is a fragmentary section of the invention in a mated condition and FIG. 5B is a schematic side elevation of the invention as it would be in the condition of FIG. 5A.
Figure 5B:
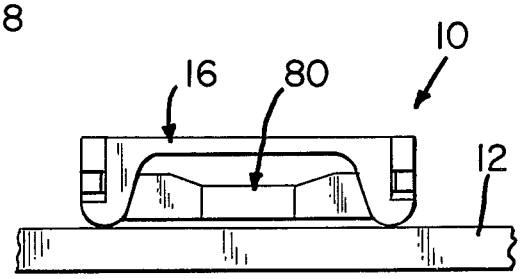

The present invention is practiced by first mounting the terminals 22, preferably through the inner frame 18 of the housing 16 into the circuit board 12 with the mounting portions 24 secured to the circuit board in known fashion, such as by soldering. The lug 26 serves a useful purpose in mounting in preventing the over insertion of the terminals 22 into the circuit board 12. The device is now in the condition as shown in FIGS. 1, 3A, and 3B. It will be noted from FIG. 3A that with the inner frame 18 abutting or being closely adjacent to the circuit board 12 will allow the arms 30, 32 to relax to their normally open condition, as shown in FIGS. 2 and 3A. In order to insert a substrate 14 into the subject connector 10, it is first necessary to apply pressure to the intermediate portions of the end rails 58, 60 of the outer frame 20, as noted by the arrow 78 in FIG. 4B. This downward deflection of the center of the outer frame 20 causes the cam arms 64, 66 to rotate on their cam surfaces 68, 70 so that the shoulders 72, 74 thereof apply upward thrust to the lugs 50, 52 causing a lifting of the inner frame 18. This lifting movement moves the inner frame 18 away from the connector board 12, in effect sliding it up along the length of the terminals 22, as shown in FIG. 4A. This movement of the inner frame 18 causes the arms 30, 32 of the terminals 22 to be forced together to a closed position so that the substrate 14 can be applied thereto. After the substrate 14 is positioned, as shown in FIG. 4A, the connector assembly is returned to the position of FIGS. 1 and 3B by removing the downward force 78 from end rails 58, 60 and pressing downwardly on the lugs 46, 48, as shown by arrow 80 to return the inner frame 18 to a position abutting the circuit board 12 and allowing the arms 30, 32 to flex outwardly into a tight gripping engagement with the conductive apertures 76 of the substrate 14. Under some circumstances, which depend upon material selection and terminal count, it may not be necessary to apply pressure to lugs 46, 48. The resiliency of outer frame 20 and the fact side rails 54, 56 engage sidewalls 34, 36 may be sufficient to lower the inner frame 18 sufficiently for the terminals 22 to make contact.

Figure 6:
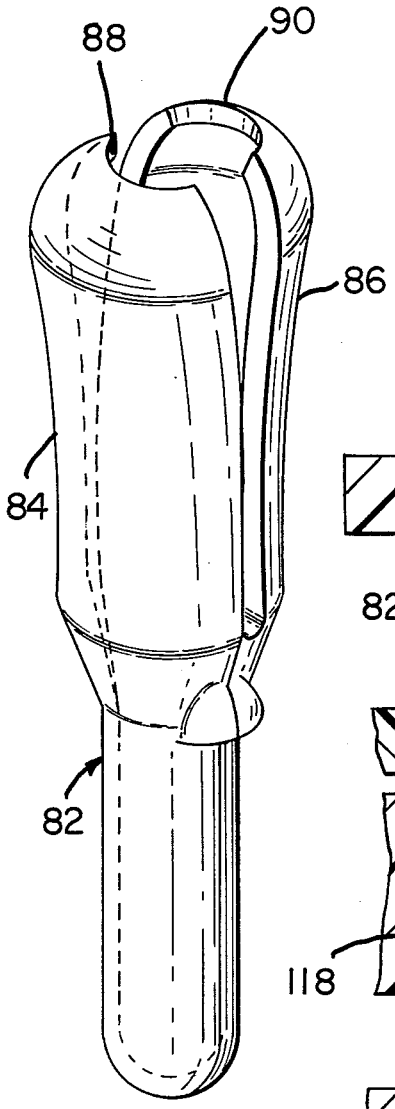
FIG. 6 is a perspective view, partially in section, of an alternate embodiment of a terminal according to the present invention.
Figure 7:
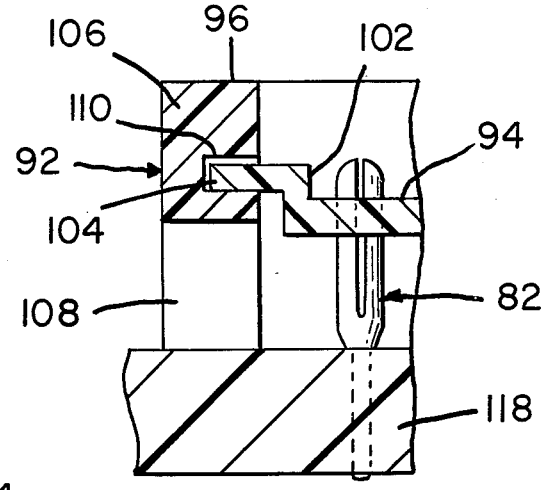
FIG. 7 is a fragmentary section taken along line 7—7 of FIG. 8B showing an alternate embodiment of the present invention.

An alternate embodiment of the subject invention is shown in FIGS. 6 to 9. The terminal 82 shown in FIG. 6 is similar to terminal 22 of FIG. 2 except that the arms 84, 86 are provided with end profiles 88, 90 which define, in the closed condition, an axial entry to the terminal. The housing 92 has an inner frame 94 and outer frame 96. The inner frame 94 is similar to inner frame 18 with a central web 98 having a plurality of apertures 100, a peripheral wall 102, and a lug 104. The outer frame 96 is similar to outer frame 20 in that it has a peripherial wall 106 and depending legs 108. Two opposite walls are provided with inwardly directed recesses 110 which receive lugs 104 therein. This embodiment would be particularly useful in making contact with an array of pin terminals 112 mounted in a circuit board 114 or connector (not shown).

Figure 8A:
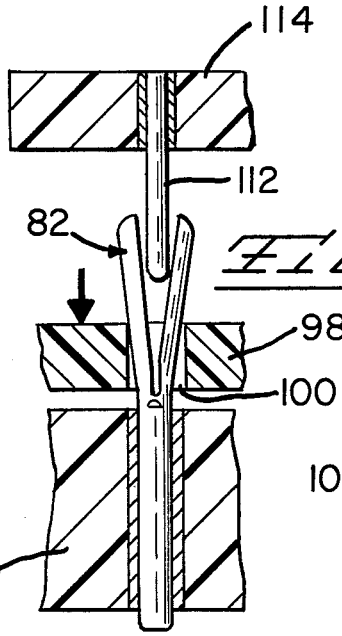
FIG. 8A is a fragmentary section through the invention of FIG. 7
Figure 8B:
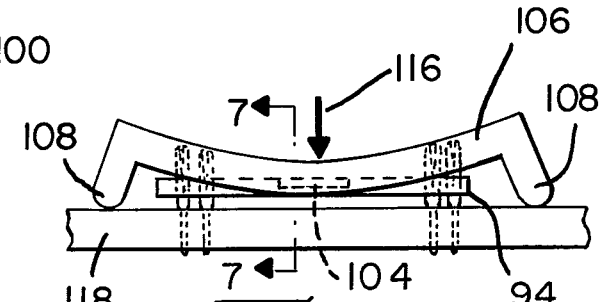
FIG. 8B is a schematic side elevation of the invention as shown in FIG. 7.
Figure 9A:
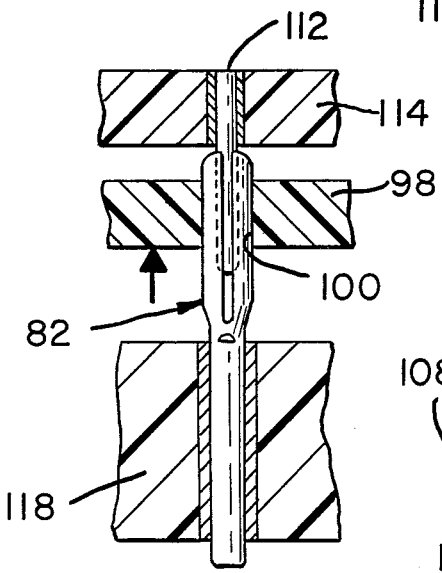
FIG. 9A is a fragmentary section through the invention of FIG. 7
Figure 9B:
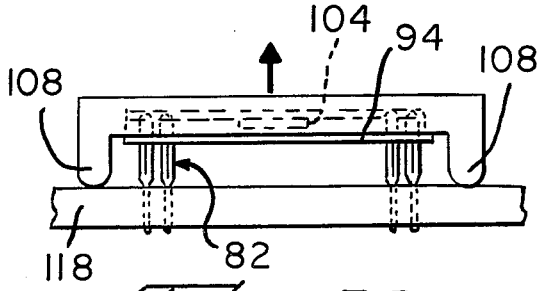
FIG. 9B is a schematic side elevation of the invention as shown in FIG. 7.

Referring now to FIGS. 8A, 8B, 9A, and 9B, it will be readily appreciated that the operation of this alternate embodiment is almost a reversal of the operation of the preferred embodiment. Insertion of the pin terminals 112 into terminals 82 takes place (see FIGS. 8A and 8B). Force is applied to the outer frame 96, as indicated by arrow 116, to drive the inner frame 94 down along the terminals 82 to touch, or be closely adjacent to, circuit board 118. During this movement the end walls of the outer frame flex, as shown in FIG. 8B, and the legs 108 slide on the circuit board 118. The terminals 82 open to the position shown in FIG. 8A and are ready to receive pin terminals 112 therein. After the pin terminals 112 are mated with their respective terminals 82, the outer frame 96 is released to return inner frame 94 to a position spaced from circuit board 118. This is movement along terminals 82 and drives them to their closed contacting position, as shown in FIG. 9A.

We claim:

1. A low insertion force connector for electrically interconnecting first and second members, said connector comprising:

a plurality of elongated first terminals each having a first mounting end adapted to electrically and mechanically fixedly engage said first member and second oppositely directed mating end formed by at least two normally diverging arms; a like plurality of second terminals fixed to said second member, said arms of said first terminals adapted to electrically and mechanically engage said second terminals; and a frame having a like plurality of apertures therein each receiving a respective first terminal therethrough, whereby movement of said frame axially of said first terminals causes said arms to be driven into and out of contact with said second terminals of said second member, said second terminals on said second member being conductive apertures, and said frame driving said arms of said first terminals together for low force insertion into said conductive apertures and releasing said arms for engagement with walls of said conductive apertures.

2. A low insertion force connector according to claim 1 wherein said terminals are stamped and formed from conductive stock material to have a substantially cylindrical overall configuration.

3. A low insertion force connector according to claim 1 further comprising:

means on each said first terminal for aligning it with respect to said first member.

4. A low insertion force connector according to claim 1 wherein each said first terminal has a pair of normally diverging arms which in a closed condition form a substantially cylindrical mating end.

5. A low insertion force connector according to claim 1 wherein said frame comprises:

an inner frame member of rigid insulative material and having said apertures therein; and an outer frame member of semi-rigid material operatively connected to drive said inner frame axially of said first terminals.

6. A low insertion force connector according to claim 5 wherein said outer frame defines a receptacle for said second member.

7. A low insertion force connector according to claim 5 further comprising:

leg means depending from said outer frame to hold it in a normal condition with respect to said first member, and means connecting said inner frame to said outer frame whereby movement of the outer frame is transmitted to move said inner frame parallel to the plane of said first member.

8. A low insertion force connector according to claim 7 wherein said inner frame is normally closely adjacent said first member.

9. A low insertion force connector according to claim 7 wherein said inner frame is normally spaced from and parallel to the plane of said first member.

* * * * *